United States Patent [19]

Jørgensen et al.

[11] 4,111,352

[45] Sep. 5, 1978

[54] TROUGH-SHAPED FOLDED CARDBOARD CONTAINER

[75] Inventors: Arne Jørgensen; Poul Berthelsen; Jørgen Bassoe, all of Korsør, Denmark

[73] Assignee: Lever Brothers Company, New York, N.Y.

[21] Appl. No.: 792,381

[22] Filed: Apr. 29, 1977

[51] Int. Cl.[2] ..... B65D 5/24

[52] U.S. Cl. ..... 229/31 R

[58] Field of Search ..... 229/31 R, 30

[56] References Cited

U.S. PATENT DOCUMENTS

| | | | |
|---|---|---|---|
| 597,731 | 1/1898 | Morrison | 229/31 R |
| 917,962 | 4/1909 | Morrison | 229/31 R |
| 920,480 | 5/1909 | Kenny | 229/30 |
| 1,158,699 | 11/1915 | McCleery | 229/30 |
| 1,271,033 | 7/1918 | Hall | 229/31 R |
| 1,555,054 | 9/1925 | Berkowitz | 229/31 R X |
| 2,138,700 | 11/1938 | Hoff | 229/31 R X |
| 3,146,933 | 9/1964 | Moore | 229/31 R |
| 3,743,169 | 7/1973 | Person | 229/31 R |
| 4,008,848 | 2/1977 | Christensson | 229/31 R |

*Primary Examiner*—Davis T. Moorhead

[57] ABSTRACT

A trough-shaped folded cardboard container for packaging fats and other foodstuffs is formed from a blank which comprises gluing flaps to be folded between extensions of two side panels and end flaps to render the container tight at its corners and at all seams. The gluing flaps have such a length that the edges at their ends abut against each other. The end flaps extend over the full height of the container, covering the gluing flaps and the vertical edges of the extensions of the side panels.

3 Claims, 2 Drawing Figures

TROUGH-SHAPED FOLDED CARDBOARD CONTAINER

FIELD OF THE INVENTION

This invention relates to a container formed from a blank of cardboard and to be used for packaging of fats and other foodstuffs.

BACKGROUND OF THE INVENTION

Containers made from cardboard are known in numerous embodiments. Their parts such as bottom and side walls are usually joined by gluing flaps. It is always difficult to make these containers tight at their corners, especially when they are used for fat-containing foodstuffs. Therefore it has been proposed to deepdraw a plastic sheet into the cardboard container as a liner, but this makes the container expensive. In U.S. Pat. No. 2,168,186 a round paper cup is proposed which consists of two side walls being connected with a square bottom, the side walls having extensions which form the other parts of the side walls and are overlappingly glued to each other. In this paper cup there are gluing flaps at the edges of the bottom and at the edges of the extensions, which gluing flaps are connected, are glued to each other and thereafter folded and glued to the extensions of the side walls. One of the drawbacks of this construction is that up to five layers of cardboard are superimposed and that it is difficult to fold and glue these layers together without having unglued areas and channels along the edges of the inner layers.

OBJECTS OF THE INVENTION

The present invention has the object of providing a container which can be erected and glued from a cardboard blank in an easy mechanical way to a shape of about a trough, the container having an improved tightness for liquids and fats.

SUMMARY OF THE INVENTION

The cardboard container of this invention comprises a rectangular bottom, two side panels extending from the bottom on two opposite sides, extensions of the side panels being bent in in order to form the two end walls, two end flaps extending from the bottom at its two other opposite side walls, and gluing flaps on the lower edges of the extensions of the side panels. The gluing flaps are also connected to the end flaps. In the ready-for-use container the gluing flaps are glued to the end flaps and are folded together with the end flaps against the extensions of the side panels. Each of said gluing flaps has such a length that they abut edge-to-edge without overlapping. The end flaps have such a shape that in the erected position they cover the gluing flaps and the vertical edges of the extensions of the side panels. Therefore, at the edge of the bottom the end flaps are as broad as the bottom but they may be smaller at the upper edge of the container, though here too, they are so broad as to allow a sufficient gluing to both of the extensions of the two side panels.

In the structure thus described the number of the layers of cardboard to be folded together is reduced. A further reduction is possible in a preferred embodiment in which also the extensions of the side panels have such a length, that their vertical edges abut against each other approximately in the middle of the end walls without overlapping.

As the gluing flaps are connected with the extensions of the side panels and with the end flaps and folded in between the extensions and the end flaps, the corners of the container are tight. As the gluing flaps do not overlap, a tight seal along the edge of the bottom can be achieved when the gluing flaps are folded against the end flap and glued to it. In erecting the container both the extensions of the nearly erected side panels at one end or both ends are bent in at the same time, the gluing flaps being folded outwardly until they are positioned on the end flaps and are glued to them. An exact position of the gluing flaps on the end flaps is achieved by the fold lines between gluing flaps and extensions and the fold lines between gluing flaps and end flaps which start from one corner of the bottom. Folding and gluing the end flaps against the extensions in a second folding operation results in a further sealing. As described, the container can be formed and glued in a very easy way by only two folding and gluing operations.

The container is made from cardboard which has been impregnated or coated on its inner side with any suitable material such as wax, lacquer or plastic to make it impervious to liquids and fats. The outer side may be printed and/or coated in the same way. The inner side of the gluing flaps is coated with an adhesive. As the inner side of the gluing flaps will be glued to the inner side of the end flaps, the end flaps are provided with an adhesive only where they are not contacted by the gluing flaps. This allows two independent gluing operations, in the first of which the gluing flaps are glued to the end flaps and in the second of which the end flaps are glued to the extensions. If the container is made with an overlapping seam between the extensions, the end flaps are coated with the adhesive only in areas near their free edges. No adhesive is required in the area of the end flaps which corresponds to this overlapping seam, except near the upper edge of the container. In case there is no overlapping seam between the extensions, all the end flaps not covered by the gluing flaps will be coated with the adhesive and the gluing flaps will be coated on both sides. A thermoplastic adhesive is preferred, which can be activated by hot air before the parts of the container are pressed together, or which can be activated by means for folding which are heated while the parts are pressed together. Though usually the end flaps will be the outer parts in the end walls, they can also be the inner parts. In this case the end flaps are erected first, then the gluing flaps are folded and glued to the end flaps and finally the extensions are fixed to the end flaps.

The upper edge of the container may be bent outwardly in any known manner, if required.

IN THE DRAWINGS

DESCRIPTION OF A PREFERRED EMBODIMENT

Figure 1:
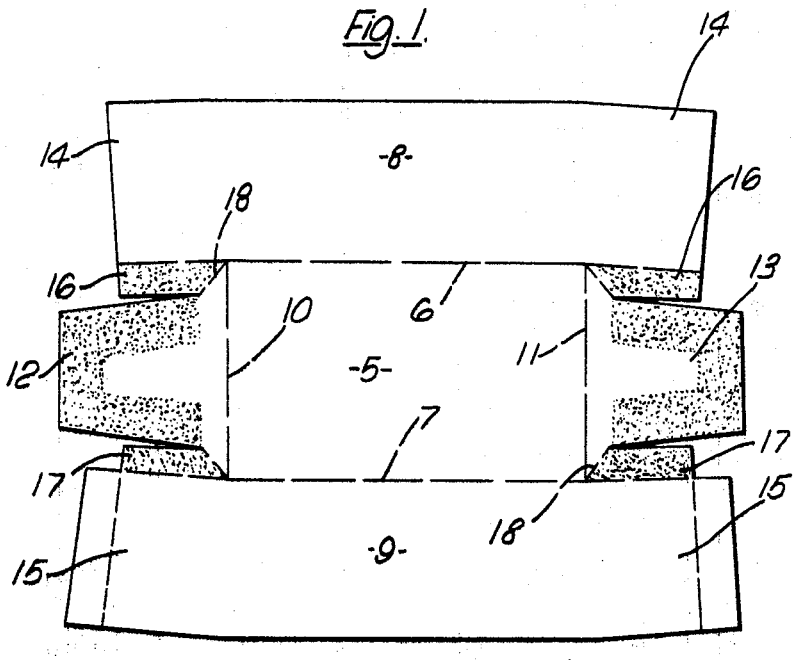
FIG. 1 is a view of a blank.

The blank for the container consists of a bottom 5, two side panels 8 and 9, having extensions 14, 15 to form the end walls, end flaps 12, 13, and gluing flaps 16, 17. The side panels 8, 9 are hingedly connected to the bottom 5 by means of fold lines 6, 7. The end flaps 12, 13 are hingedly connected to the bottom 5 over fold lines 10, 11. The gluing flaps 16, 17 are connected to the side panels 8, 9 by fold lines in continuation of the fold lines 6, 7 of the bottom. They are also connected to the end flaps 12, 13 by means of fold lines 18 starting at the corners of the bottom 5 and extending at an angle of about 45° to the fold lines 10, 11 in outward direction. The length of the gluing flaps 16, 17 is half the length of the fold lines 10, 11 so that the edges of the ends of the gluing flaps 16, 17 can abut against each other.

The inner side of the gluing flaps 16, 17 and the area of the end flaps 12, 13 which is adjacent to their free edges is coated with a thermoplastic adhesive, as is shown in FIG. 1 by hatching or dotted lines.

In the embodiment shown the side panels 9 are longer than the side panels 8, so that they can form an overlapping seam. Also the ends of the side panels 9 may be coated with a thermoplastic adhesive. However, as set out before with respect to other embodiments, such an overlapping seam is not necessary, because in any case both extensions 14, 15 are glued to the end flaps 12, 13.

In the first folding operation the side panels 8, 9 are erected and at the same time the extensions 14, 15 are bent in, the gluing flaps 16, 17 folding outwardly over the fold lines 18 and the continuations of the fold lines 6, 7. During this folding operation hot air is blown against the inner side of the gluing flaps 16, 17, activating the adhesive thereon, but not heating the adhesive on the end flaps 12, 13. With the aid of the fold lines 18 the gluing flaps 16, 17 get into their position and are fixed on the end flaps 12, 13 when the side panels 8, 9 and the extensions 14, 15 reach their final positions.

In the second folding operation the end flaps 12, 13 are folded and glued against the extensions 14, 15 after or while the adhesive on their inner sides is activated by hot air and the end walls are pressed together and cooled.

Figure 2:
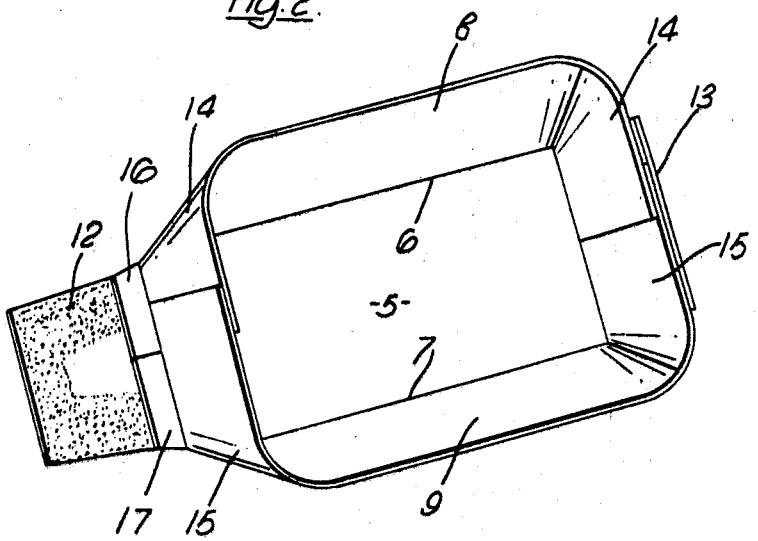
FIG. 2 is a perspective view of a container, one end of which is shown after the first folding operation, the other end being shown in the final state.

As can be seen in FIG. 2, the end flaps 12, 13, extending over the full height of the container, contribute to the trough-like shape of the container by partly doubling the bend in extensions 14, 15 and the end walls respectively. Only besides the end flaps 12, 13 round corners of the extensions 14, 15 can be formed, whereas near the bottom the container has corners which are approximately rectangular.

We claim:

1. A trough-shaped folded cardboard container which comprises a rectangular bottom, two side panels extending from and hinged to the bottom on two opposite sides, extensions of the side panels being bent in to form the end walls, two end flaps extending from and hinged to the bottom at its two other opposite edges, gluing flaps hingedly connected to the lower edges of the extensions of the side panels by fold lines parallel to the lower edges of said extensions and, by means of fold lines starting from the corners of the bottom, also hingedly connected to the end flaps, said gluing flaps being folded and glued to the unfolded end flaps and said gluing flaps each having such a length that they abut edge-to-edge, and the end flaps with the gluing flaps on them being folded against the bent-in extensions of the side panels and joined to said extensions covering the vertical edges of said extensions as well as the gluing flaps, the end flaps extending over the full height of the container.

2. A trough-shaped folded container comprising a rectangular bottom, two side panels hinged by score lines to respective opposite edges of said bottom and having each a longitudinal extent which is greater than and extends beyond the longitudinal extent of said bottom, the portions of said panels which extend beyond said bottom constituting extensions of said panels beyond each end of said bottom, two end flaps hinged to respective other opposite edges of said bottom by score lines in mutually perpendicular relation with the score lines between said bottom and said side panels, and gluing flaps hinged to said extensions by score lines which are colinear with corresponding ones of the score lines between said bottom and said side panels, said gluing flaps having free edges separated from corresponding free edges of said end flaps, one free edge of each of said gluing flaps and a corresponding free edge of each of said end flaps intersecting at a respective juncture remote from said score lines which are in mutually perpendicular relation between said end flaps and said side panels, each of said gluing flaps also being hinged to a corresponding one of said end flaps along a respective score line intersecting at one end a corresponding one of said junctures of intersection between said gluing flaps and said end flaps and at the other end corresponding ones of said score lines which are in mutually perpendicular relation between said end flaps and said side panels, said junctures of intersection between said gluing flaps and said end flaps defining a lateral span of each of said end flaps which is less than the extent of corresponding ones of said score lines between said bottom and said end flaps, said gluing flaps being arranged to extend in respective pairs across a portion of corresponding ones of said end flaps in interposition between a corresponding one of said end flaps and a corresponding pair of said extensions of said side panels.

3. The cardboard container of claim 1 wherein the extensions of the side panels have such a length that their vertical edges abut against each other in the middle of the end flaps.

* * * * *